US009802630B2

(12) United States Patent
Bartolotti

(10) Patent No.: US 9,802,630 B2
(45) Date of Patent: Oct. 31, 2017

(54) VEHICLE SAFETY RAILROAD CROSSING SYSTEM

(71) Applicant: Frank J. Bartolotti, Millbrook, NY (US)

(72) Inventor: Frank J. Bartolotti, Millbrook, NY (US)

( * ) Notice: Subject to any disclaimer, the term of this patent is extended or adjusted under 35 U.S.C. 154(b) by 0 days.

(21) Appl. No.: 15/147,461

(22) Filed: May 5, 2016

(65) Prior Publication Data

US 2017/0267265 A1 Sep. 21, 2017

Related U.S. Application Data

(60) Provisional application No. 62/309,927, filed on Mar. 17, 2016.

(51) Int. Cl.

| | |
|---|---|
| ***B61L 3/00*** | (2006.01) |
| ***B61L 3/08*** | (2006.01) |
| ***B61L 23/00*** | (2006.01) |
| ***B61L 27/04*** | (2006.01) |
| ***B61L 29/00*** | (2006.01) |

(52) U.S. Cl.

CPC ..... *B61L 3/08* (2013.01); *B61L 23/007* (2013.01); *B61L 27/04* (2013.01); *B61L 29/00* (2013.01); *B61L 2201/00* (2013.01)

(58) Field of Classification Search

CPC .... B61L 3/00; B61L 3/08; B61L 23/00; B61L 23/07; B61L 27/00; B61L 27/04; B61L 29/00; B61L 2201/00

See application file for complete search history.

(56) References Cited

U.S. PATENT DOCUMENTS

| | | | | |
|---|---|---|---|---|
| 5,890,682 | A * | 4/1999 | Welk | B61L 29/24 246/122 R |
| 2004/0006413 | A1* | 1/2004 | Kane | B61L 3/008 701/19 |
| 2006/0118678 | A1* | 6/2006 | Wells, II | B61L 23/00 246/121 |
| 2007/0170315 | A1* | 7/2007 | Manor | B61L 23/041 246/167 R |
| 2009/0105893 | A1* | 4/2009 | Kernwein | B61L 25/025 701/19 |
| 2010/0163687 | A1* | 7/2010 | Brand | B61L 3/127 246/117 |
| 2011/0093144 | A1* | 4/2011 | Goodermuth | B60T 13/665 701/20 |
| 2015/0060608 | A1* | 3/2015 | Carlson | B61L 3/125 246/122 R |
| 2015/0302752 | A1* | 10/2015 | Holihan | G08G 1/164 246/62 |
| 2015/0314796 | A1* | 11/2015 | Maeyama | B61B 13/04 701/19 |

* cited by examiner

*Primary Examiner* — Jason C Smith
(74) *Attorney, Agent, or Firm* — Ray K. Shahani

(57) ABSTRACT

A vehicle safety railroad crossing system comprising a system for preventing collisions between trains and motor vehicles at railroad crossings. The vehicle safety railroad crossing system functions to alert the train's engineer and brakeman of the vehicle ahead obstructing the tracks, and automatically apply the train's brakes to prevent a collision.

4 Claims, 7 Drawing Sheets

VEHICLE SAFETY RAILROAD CROSSING SYSTEM

RELATED APPLICATIONS

This Application is a regular utility application based on Provisional Patent Application Ser. No. 62/309,927 entitled "VEHICLE SAFETY RAILROAD CROSSING" by Frank J. Bartolotti filed Mar. 17, 2016, which is incorporated by reference herein in its entirety and claims any and all benefits to which it is entitled therefrom.

FIELD OF THE INVENTION

The present invention is a vehicle safety railroad crossing system comprising a system for preventing collisions between trains and motor vehicles at all railroad crossings. Designed to save both lives and property, the vehicle safety railroad crossing system functions to alert the train's engineer and brakeman of the vehicle ahead obstructing the tracks, and automatically apply the train's brakes to prevent a collision.

BACKGROUND OF THE INVENTION

The United States railroad system consists of over 750 railroads running on 140,000 miles of track. Every day trains travel across more than 212,000 highway/rail so-called grade crossings. A grade crossing is a location where a public highway, road, street, or private roadway, including associated sidewalks, and pathways, crosses railroad tracks at grade, i.e., at the same level as the street. There are also more than 38,000 locations were railroad tracks and roadways cross at different levels.

According to the Federal Railroad Administration (FRA), there are about 270 deaths a year at public and private grade crossings. These deaths include pedestrians, but are predominantly due to train-versus-vehicle collisions. Largely through the FRA's safety programs, the number of fatalities has gone down by 54 percent over the last two decades. According to the FRA, trespassing along railroad rights-of-way is the leading cause of rail-related pedestrian deaths in America. Nationally, more than 431 trespass fatalities occur each year, and nearly as many injuries, the vast majority of which are preventable. Whether in a vehicle at a rail-crossing or as a pedestrian walking in the railroad right-of way, the reality is that nearly every 180 minutes in America, someone is hit by a train. Combined, highway/rail-crossing and trespasser deaths account for 95 percent of all rail-related deaths and most of these deaths are avoidable. Being struck by a train almost always means death for the motorist, but that can often be only the beginning of a larger, cascading disaster as the locomotive and cars of the train, one after another, derail. Regardless of whether the train in question is carrying crude oil, chlorine, or passengers, the effects of that initial collision continue long after that impact. What is needed is some more-effective means of preventing such collisions from occurring in the first place. The present invention prevents trains from colliding with vehicles at all rail crossings equipped with a sensor scale triggered to brake the approaching train.

Several references in the prior art show train safety systems. U.S. Pat. Nos. 5,554,982, 5,699,986 and 5,864,304 all show various systems which try to alert a train engineer of a vehicle, person, or blockage on the railroad tracks and try to allow time for train stoppage before collision. However, none of these patents teaches the vehicle safety railroad crossing system of the present invention.

Here in the United States and World Wide there are three (3) basic types of railroad crossings. These three types are as follows:

A. The first type of crossing is a sign with no lights or no bells. The sign simply states "Railroad Crossing" or uses an abbreviation such as "RR Crossing" or similar.

B. The second type of crossing is a pole with a sign, as above, but also with a flashing red light and/or a ringing bell to signify that a train is approaching.

C. The third type of railroad crossing is the gate system where gates come down and block the crossing, along with flashing lights and ringing bells to alert on-comers that a train is approaching.

For all 3 types of crossings there must be some type of a ramp to get over the tracks. Otherwise the vehicle will always get stuck in the tracks. A solar panel can be used for power in areas where there is no electric power line available. This is useful in condition type A, mentioned above. It will be understood that in conditions B and C, an electrical hook up at the crossing to power the gates and bells is always necessary. At a point down the track about a half of a mile or more, the train reaches a certain point and trips a switch that powers the gates to go down and activates the bells and lights to signal to cars or trucks of the oncoming train. Theoretically, vehicles cannot enter the crossing once the gates are down. Sometimes, however, vehicles get stuck at the crossing while the gates are down. There is nothing in the prior art that detects a vehicle or other object located in the middle of an intersection on top of the tracks at a rail crossing and trips the brakes of the train before the train collides with the vehicle stuck in the railroad crossing.

SUMMARY OF INVENTION AND ADVANTAGES

The vehicle safety railroad crossing system of the present invention would equip the nation's railroad crossings with a unique technological innovation designed to save lives and property: a system that would sense the presence of a motor vehicle in the crossing as a train approaches, act to alert the train's engineer and brakeman, and automatically apply the train's brakes.

The beneficiaries of the vehicle safety railroad crossing system of the present invention, or those who would most benefit from its installation at railroad crossing, would not only be the owners and operators of the trains that travel the rails but also owners and operators of motor vehicles, i.e., the so-called automotive aftermarket. This automotive aftermarket might also include professional drivers, such as the operators of long-haul trucks, and tax and limousine services.

While the most obvious beneficiaries of the vehicle safety railroad crossing system would be motorists, the system itself would likely be installed at crossings by the railroad companies. As was noted previously, the U.S. railroad system consists of hundreds of railroads running on thousands of miles of track. It is an object and advantage of the present invention to enhance safety at the large number of U.S. grade and other rail crossings.

One object of the present invention is to provide an efficient and economical way to reduce traffic accidents caused by stalled vehicles stuck on a railroad track at a railroad crossing.

Another object and advantage of the present invention is to provide a fail-safe system whereby sensors located adjacent a railroad track at a railroad crossing that detect the presence of any large stationary object transmit a signal to a point distal to the railroad crossing such that an eminently approaching train will be braked and stopped by activation of an electronic or mechanical trip-switch.

Yet another object and advantage of the present invention is to provide a system that brakes and stops a train automatically, such as in the absence or unavailability of brakeman/operator intervention.

Yet a another object and advantage of the present invention is to provide a vehicle safety railroad crossing system that has a predetermined minimum vehicle weight requirement for activation.

Yet a another object and advantage of the present invention is to provide a vehicle safety railroad crossing system that has weight sensors built into the ramps leading up to and across the railroad tracks.

Yet a another object and advantage of the present invention is to provide a vehicle safety railroad crossing system in which the presence of transitory vehicles or other objects is distinguished and differentiated from the presence of stationary, non-moving vehicles or other objects resting upon the railroad tracks at the crossing that pose risk of being struck by an eminently passing train.

Yet a another object and advantage of the present invention is to provide a vehicle safety railroad crossing system which not only prevents damage to vehicles and trains, but also reduces the incidence of road and rail closures for repair, medical treatment of injured persons and collision investigations, which in turn reduced traffic congestion, commuter trains delays, etc.

Benefits and features of the invention are made more apparent with the following detailed description of a presently preferred embodiment thereof in connection with the accompanying drawings, wherein like reference numerals are applied to like elements.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

Figure 1:
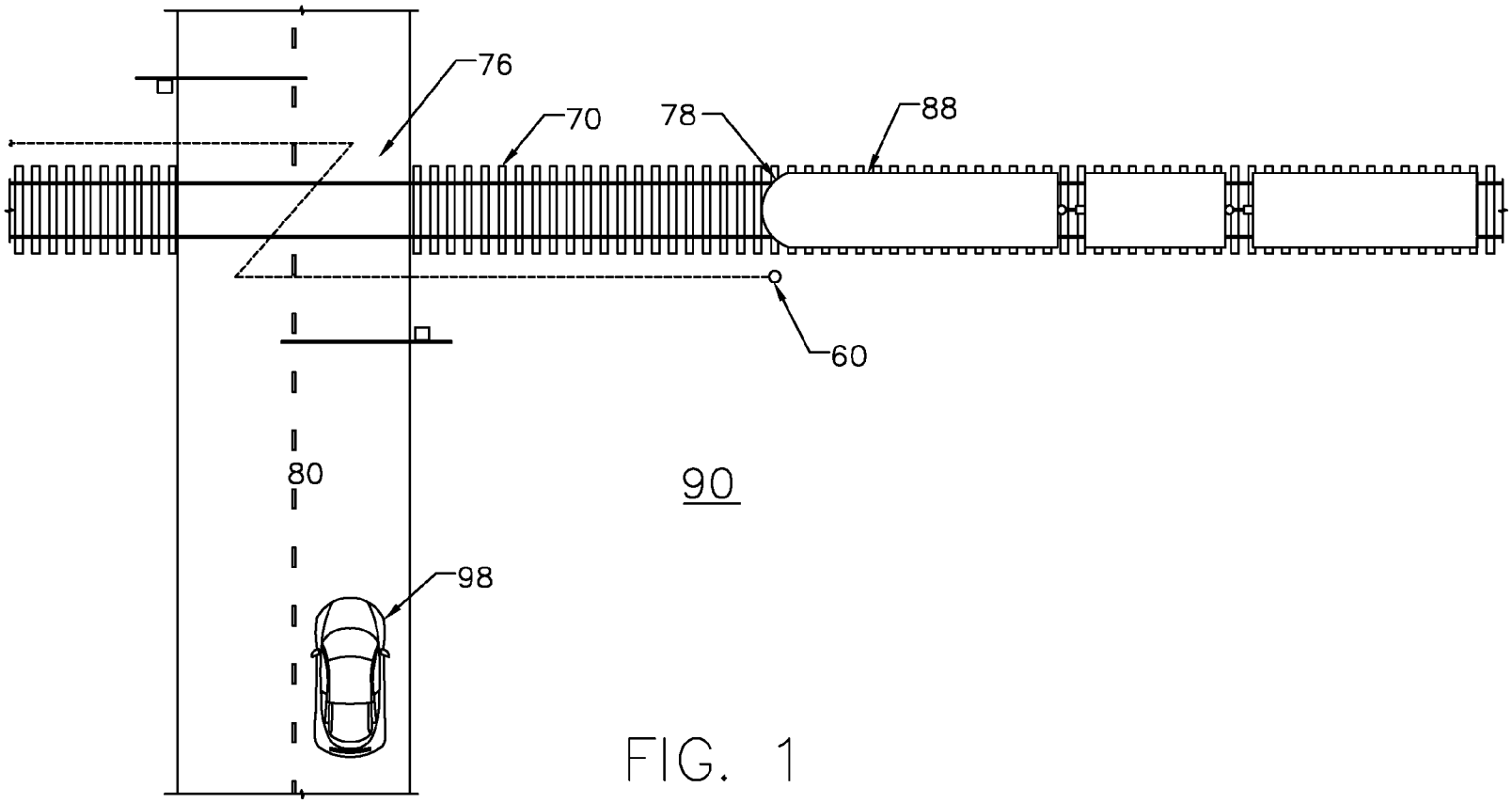
FIG. 1 (PRIOR ART)
FIG. 1 (prior art) shows a representative typical railroad crossing 90.

FIG. 1 (prior art) shows a representative typical railroad crossing 90. As is well known, the typical railroad crossing 90 consists of a road with 1 or more lanes 80 and a location or intersection 76 where a set of railroad tracks 70 cross the road 80. In a typical railroad crossing 90 in which the railroad crossing is indicated by a system in which an audible, illuminated sign or moving gate arms (not shown), there is an electrical connection, such as wire enclosed in conduit, that communicates from the intersection 76 to a distal point 78. When an eminently approaching train 88 passes the distal point 78, an electrical or mechanical-type of trip switch 60 transmits an electrical signal to the railroad crossing lights, bells and optionally gate arms, thereby activating the railroad crossing 90 lights, alarm, bell and/or moving gate arms. When the railroad crossing 90 is activated, the operator of an approaching car or other motor vehicle 98 will be advised of the dangers of proceeding through the intersection 76, or will actually be prevented from passing there through by moving gate arms.

Figures 2A, 2B:
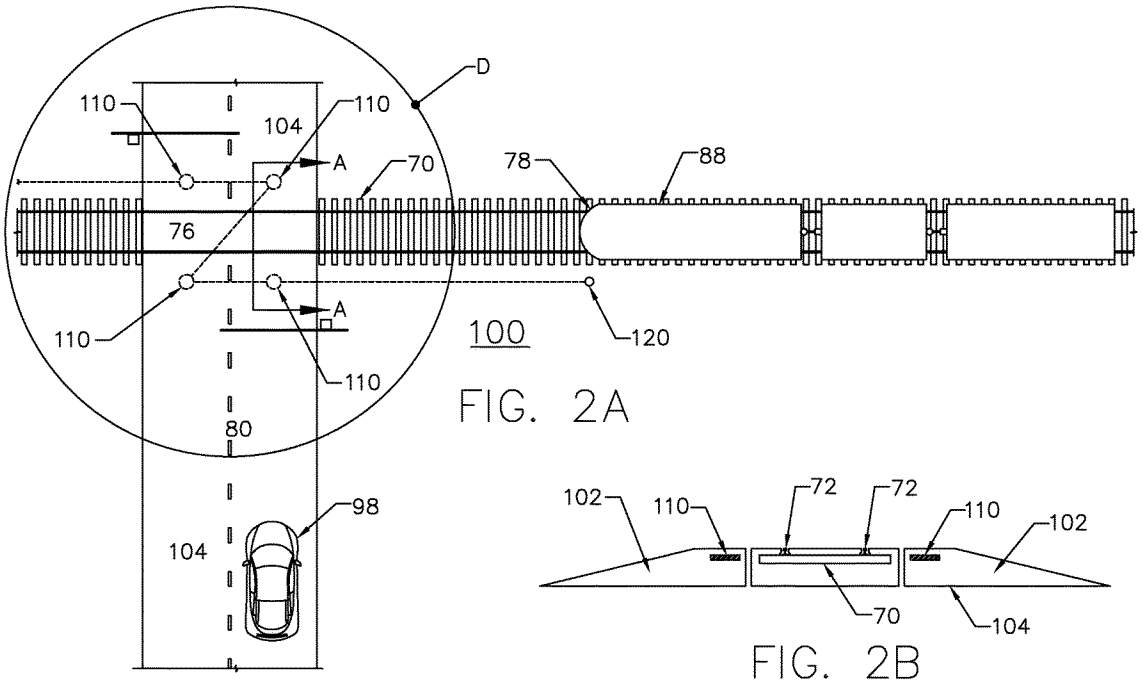
FIG. 2A is a representative top view of the vehicle safety railroad crossing system 100 of the present invention.
FIG. 2B is a representative section view of the vehicle safety railroad crossing system 100 shown in FIG. 2A taken at A-A.
Figure 2C:
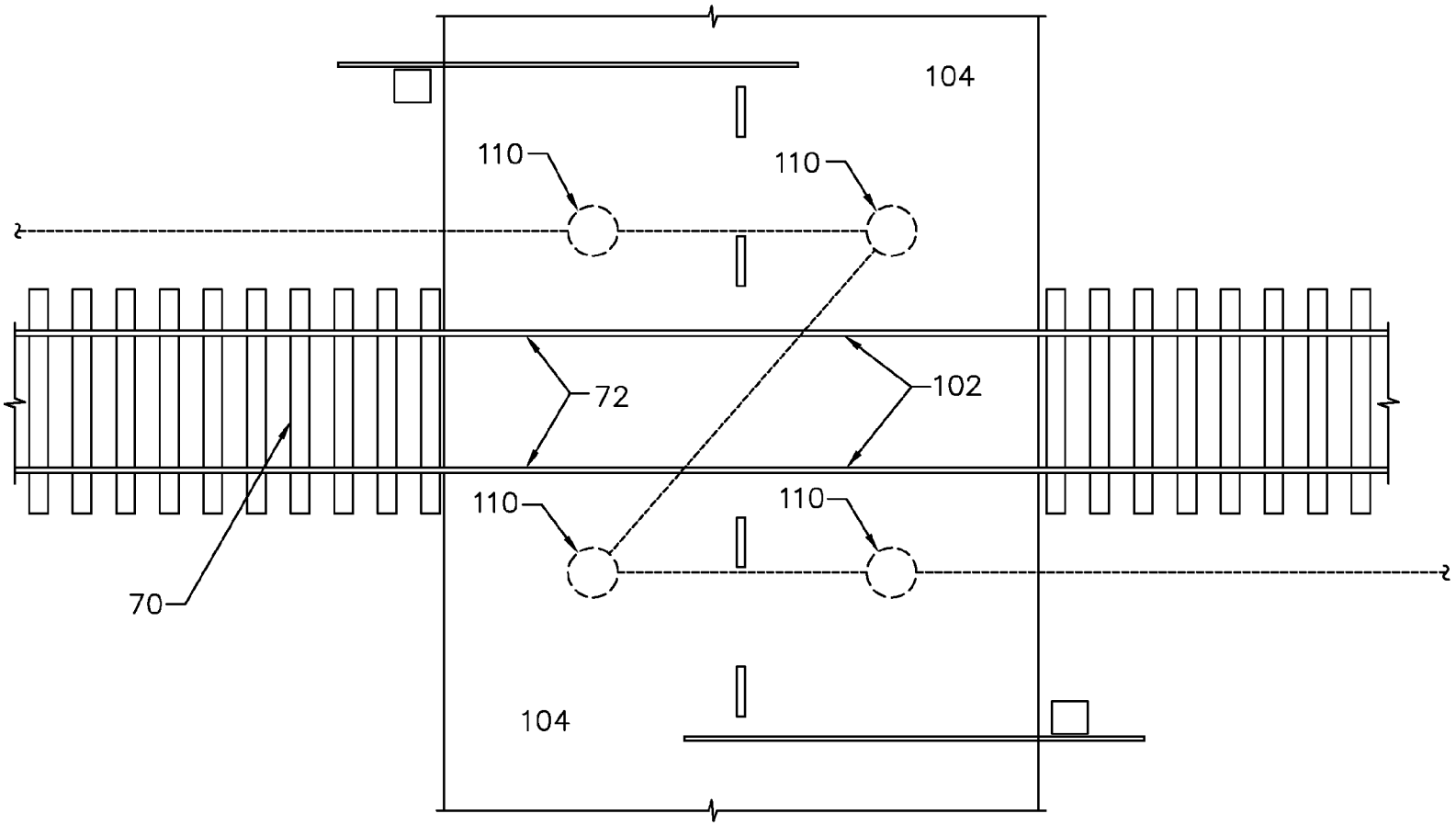
FIG. 2C is representative top detail view D of the vehicle safety railroad crossing system 100 shown in FIG. 2A.

FIG. 2A is a representative top view of the vehicle safety railroad crossing system 100 of the present invention. FIG. 2B is a representative section view of the vehicle safety railroad crossing system 100 shown in FIG. 2A taken at A-A. FIG. 2C is representative top detail view D of the vehicle safety railroad crossing system 100 shown in FIG. 2A. The vehicle safety railroad crossing system-enhanced railroad crossing 100 of the present invention comprises a set of railroad tracks 70 that in general run perpendicular or essentially perpendicular to a one or more lane street, road or highway 80. It will be understood that the vehicle safety railroad crossing system-enhanced railroad crossing 100 of the present invention can be installed at intersections 100 in which the railroad tracks 70 run at an angle to the road 80. In either case, ramp portions 102 are installed in the intersection 100 at both sides of the railroad tracks 70 such that as a vehicle 98 approaches the crossing area 104 of the intersection 100, the ramp portions 102 raise the vehicle off the grade level 104 to allow the vehicle 98 to clear the elevated rails 72.

In order to sense the presence of a stalled or otherwise stationary vehicle 98 at risk or in danger of being struck by a passing train 88, weight sensors 110 are installed adjacent the rails 72 of the railroad track 70 underneath the ramp portions 102 on either one side or both sides of the railroad tracks 72 within the crossing area 104 of the intersection 100. The weight sensors 110 are placed at a location underneath or within the ramp portions 102 adjacent the railroad tracks 72. If a stalled or stationary vehicle 98 is detected by the weight sensor 110, and the system 100 determines that the vehicle 98 is not moving, then a signal is sent to trip switch 120. This notifies approaching train 88 a sufficient distance from the crossing area 104 intersection such that the approaching train 88 can stop before striking the vehicle 98.

Figure 3A:
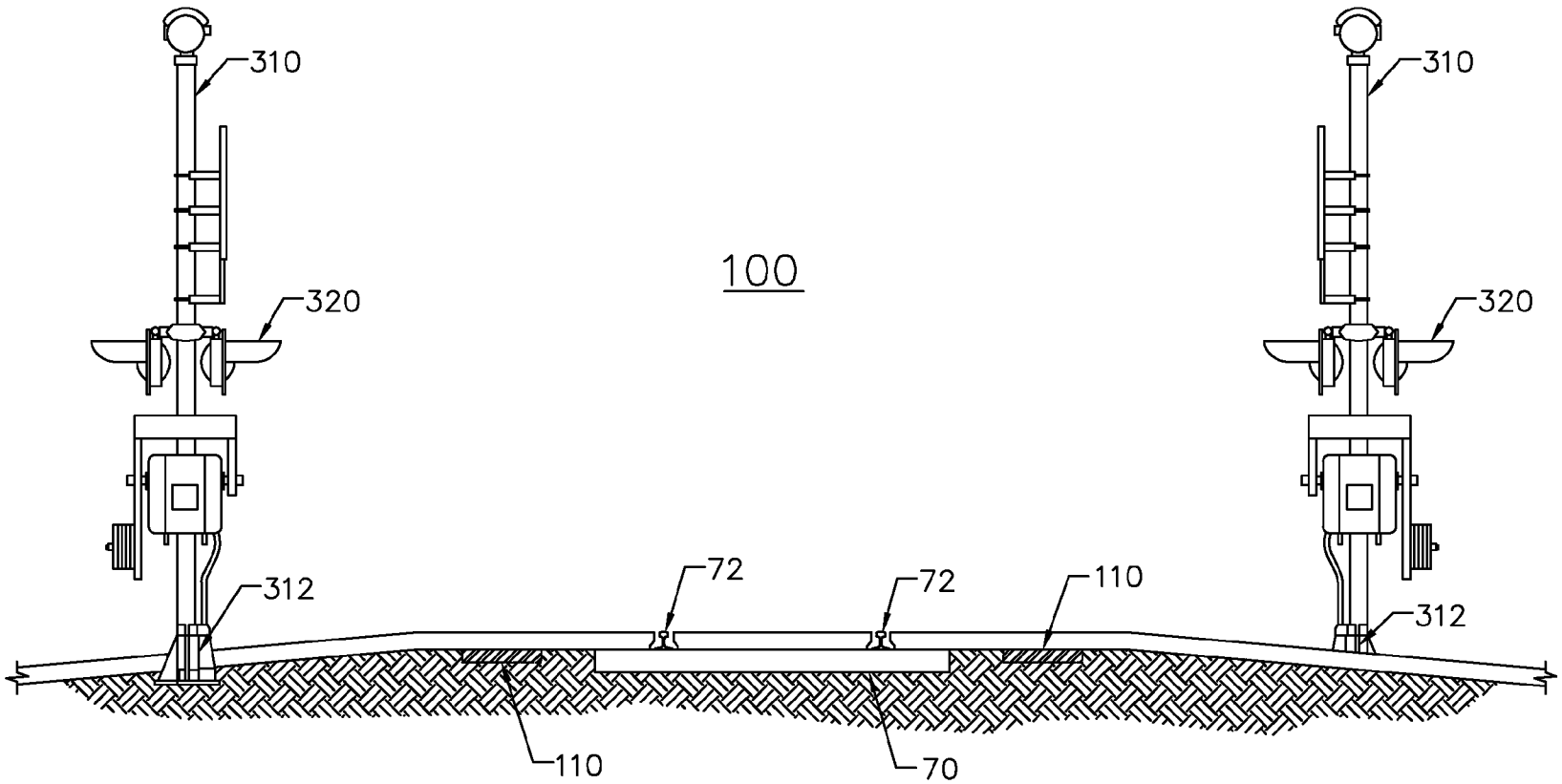
FIG. 3A is a representative side view of the vehicle safety railroad crossing system 100 of the present invention implemented in conjunction with a railroad crossing having moving gate arms 300, looking in a direction parallel to the railroad tracks 70.
Figure 3B:
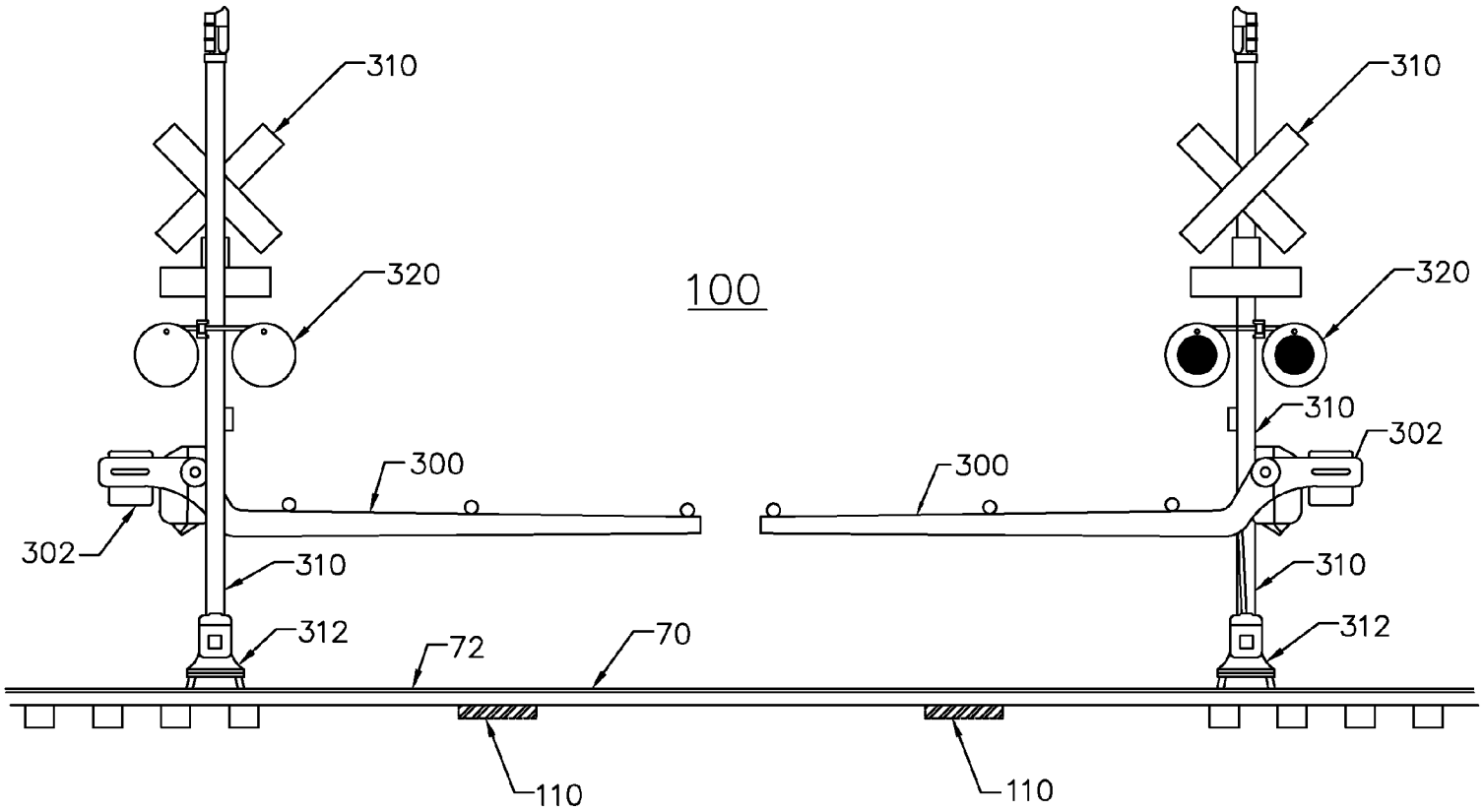
FIG. 3B is a representative side view of the vehicle safety railroad crossing system 100 of the present invention implemented in conjunction with a railroad crossing having moving gate arms 300, looking in a direction perpendicular to the railroad tracks 70.

FIG. 3A is a representative side view of the vehicle safety railroad crossing system 100 of the present invention implemented in conjunction with a railroad crossing having moving gate arms 320, looking in a direction parallel to the railroad tracks 70. FIG. 3B is a representative side view of the vehicle safety railroad crossing system 100 of the present invention implemented in conjunction with a railroad crossing having moving gate arms 300, looking in a direction perpendicular to the railroad tracks 70. The improved railroad crossing system 100 of the present invention can be used in locations where a conventional railroad crossing with gate arms 300 is used. Such railroad crossings comprise a base portion 312 that supports a center mast 310, with gate arms 300 and counterweights 302, flashing lights 320 and a crossbuck sign 310 mounted thereon.

Figure 3D:
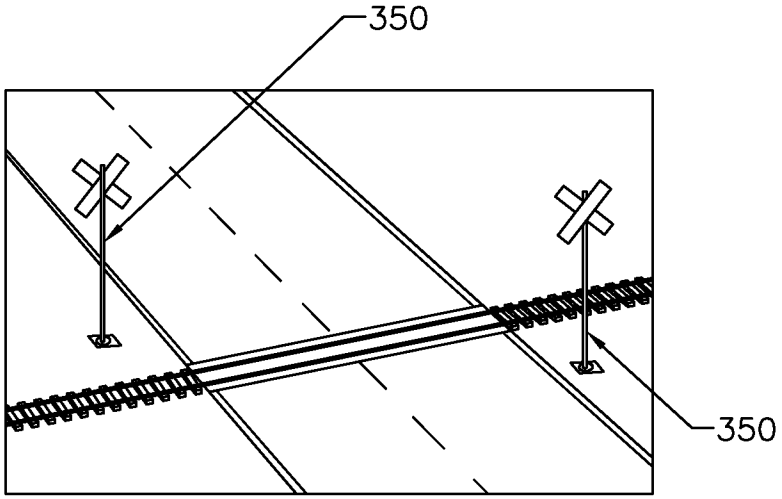
FIG. 3D is a representative perspective view of the vehicle safety railroad crossing system 100 of the present invention implemented in conjunction with a railroad crossing having conventional railroad crossing verbiage or symbols 350.
Figure 3C:
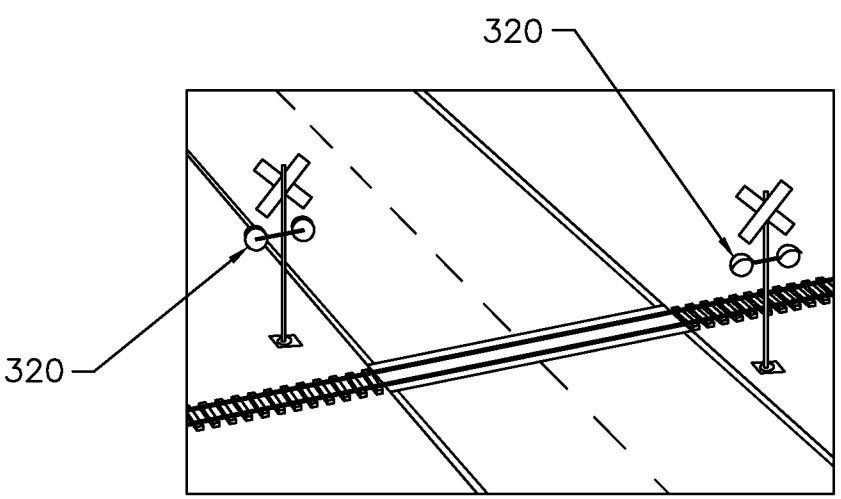
FIG. 3C is a representative perspective view of the vehicle safety railroad crossing system 100 of the present invention implemented in conjunction with a railroad crossing having lights 320.

FIG. 3C is a representative perspective view of the vehicle safety railroad crossing system 100 of the present invention implemented in conjunction with a railroad crossing having only lights 320.

FIG. 3D is a representative perspective view of the vehicle safety railroad crossing system 100 of the present invention implemented in conjunction with a railroad crossing having conventional railroad crossing verbiage or symbols 350.

Figure 4:
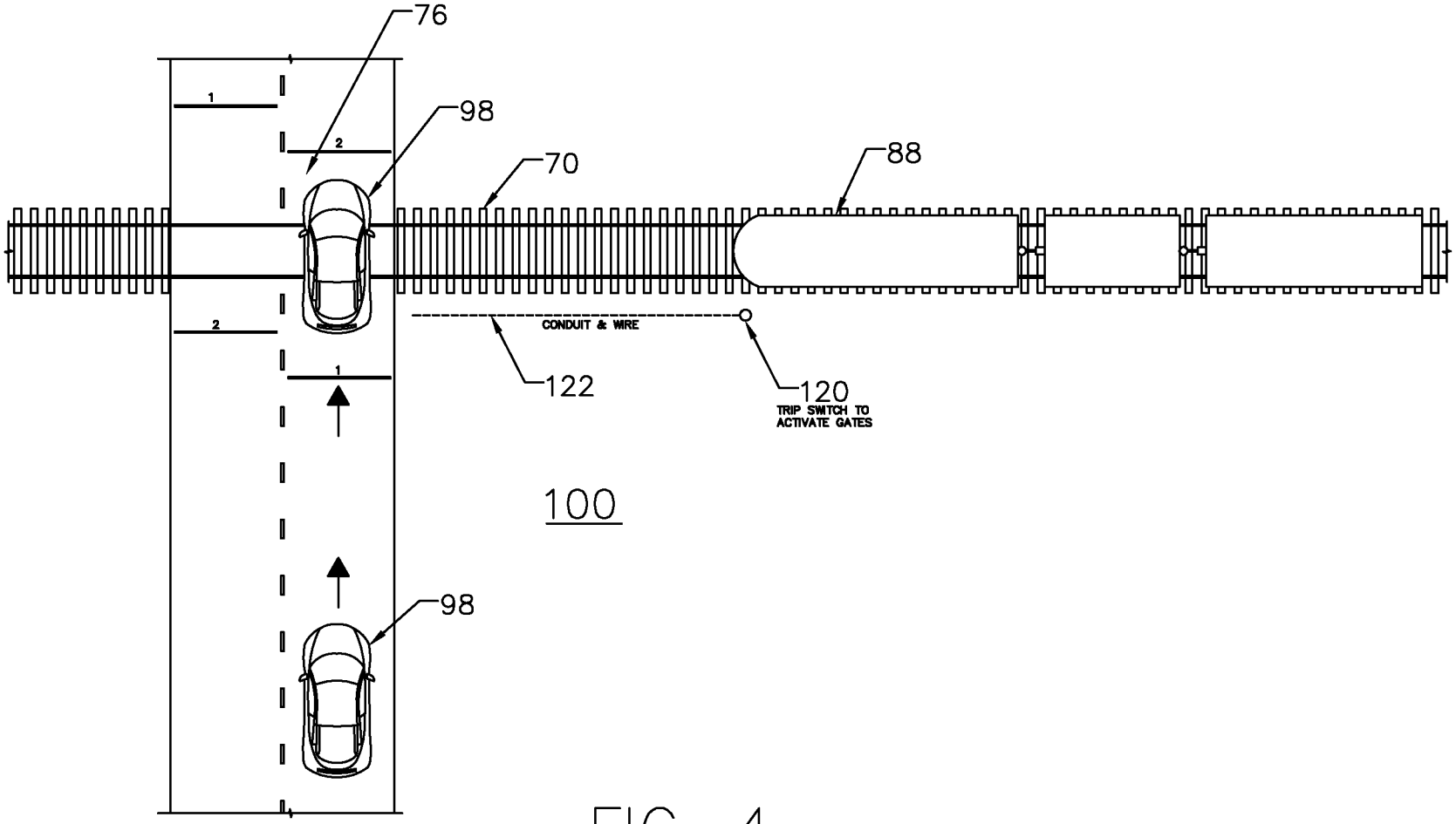
FIG. 4 is a representative top view of the vehicle safety railroad crossing system 100 of the present invention illustrating a method of use of the present invention.

FIG. 4 is a representative top view of the vehicle safety railroad crossing system 100 of the present invention illustrating a method of use of the present invention. As described above, in the event a vehicle 98 stops or is unable to proceed out of the cross-walk 76 zone of danger, the vehicle weight is detected by scales or weight sensor 110. The scales or sensors 110 trigger a switch 120, such as by transmitting a signal along wire 122 or transmitted signal which is able to communicate with oncoming train 88. Thus, the train will be notified and the brakes can automatically be activated, thus stopping the train 88 long before it collides with the vehicle 98 stopped in the intersection 76.

Railroad Crossing Safety Feature for all 3 Types of Crossings

The present invention 100 is a retrofit assembly that is installed under the ramps 102 that lead over the railroad tracks 70 at virtually all railroad crossings. An installed weight sensor or scale 110 only gets activated when substantial weight up to 1,000 pounds or more stays on the tracks 72 at the crossing 100 for 30 seconds or more. The precise parameters including weight range and timing can be adjusted by the railroad companies or other users of the system 100. The stopping feature must be wired with the gates and signal devices down the tracks about a mile or more. The distances between devices can be adjusted by the railroad companies or other users of the system. Thus, if a car or truck gets stuck on the crossing, the weight will activate the scale that will send a signal down the tracks to the trip switch. The trip switch will then apply the brakes to the trains and stop the train automatically.

Thus, the present invention requires a group of scales wired to a sensor wired to a trip switch. As suggested above, crossing type A would need to have solar panels installed to provide the electric to the scales, devices and switches. The scale would indicate that there is a vehicle on the tracks, which would then send a signal to the trip switch to stop the train. Even in an event where the motormen would be unable to stop the train, this system will work automatically.

The wiring, scales, sensor and distance to the trip switch can all be adjusted by the railroad companies operating the system to suit their conditions. This system can be used world wide and is cheaper to retrofit than building overpasses or underpasses.

The vehicle safety railroad crossing system would work on double gate crossings, crossings with bells and lights, and crossings with just signs. As a train travels down the track, a sensor is triggered and the gates go down, or crossing signals are activated. The vehicle safety railroad crossing system would affordably install scales under the ramps at each railroad crossing. The scales would detect weights up to and in excess of 1000 lbs which either linger on the tracks for more than 30 seconds (or another amount of time designated by the Railroad system), or are on the tracks as the train is approaching. When tripped, this system would send an alert signal to the approaching train that a vehicle is stopped on the tracks. The train's engineer and brakeman can then stop the train before a collision occurs, or the safety trigger alert could stop the train automatically when a signal is received, or if the brakeman fails to stop the train. The details are to be determined, however, the alert could be issued to any train within a 1 mile or more range. Electrical conduit would be used, and solar panels would serve to supply power to the scales, devices, and switches. It will be understood that the physical wiring, scales, sensors, and distance settings can all be installed, adjusted and maintained by the various railroad companies that use them. Among the benefits and advantages of the vehicle safety railroad crossing system, the most important is the increase in safety—for both motorists and trains—that it would provide. And the vehicle safety railroad crossing system would operate automatically to brake a train approaching an imminent collision. Less expensive than building overpasses and underpasses to avoid railroad crossings, the vehicle safety railroad crossing system should have a strong appeal for the nation's railroads—and provide far greater safety not only for the nation's motorists, but for its railroads as well.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A motor vehicle safety railroad crossing system for automatically stopping a train when a car or other motor vehicle is obstructing a railroad crossing, the motor vehicle safety railroad crossing system comprising:

one or more weight sensors mounted adjacent a railroad track within a railroad crossing for motor vehicles, the weight sensors capable of distinguishing the transitory presence of motor vehicles crossing the railroad tracks and the prolonged presence of a motor vehicle at rest within the railroad crossing;

an electric wire that extends between the railroad crossing to the location of the approaching train for transmitting a signal, the signal based upon the weight of the motor vehicle determined by the one or more weight sensors located in the railroad crossing, to an approaching train; and switch means selected from the group of mechanical trip switches and electronic trip switches, for automatically deploying the train's brakes to avoid collision with a motor vehicle resting on the railroad tracks.

2. The motor vehicle safety railroad crossing system of claim 1, further comprising a central processing unit, the central processing unit determining the presence of a motor vehicle at rest on the railroad tracks based upon the presence of signal from the one or more weight sensors.

3. A method for automatically stopping an approaching train in the event a motor vehicle is obstructing a railroad crossing, the method consisting of the following steps:

A. Installing one or more weight sensors adjacent the railroad tracks within a railroad crossing;

B. Installing a mechanical or electronic trip switch on a train;

C. Installing a hard wire between the weight sensors adjacent the railroad tracks and a point distal from the railroad tracks B. Distinguishing the transitory presence of motor vehicles crossing the railroad tracks and the prolonged presence of a motor vehicle at rest within the railroad crossing;

C. When a motor vehicle is at rest within the railroad crossing, transmitting a signal from the location of the railroad crossing to the distal location of an approaching train along the hard wire;

D. Communicating the signal to the mechanical or electronic switch on the approaching train;

E. Activating the brakes of the train; and

F. Stopping the train prior to collision with the motor vehicle at rest on the railroad tracks.

4. A method for automatically stopping an approaching train using a mechanical trip switch in the event a motor vehicle is obstructing a railroad crossing, the method consisting of the following steps:

A. Installing (i) one or more weight sensors adjacent the railroad tracks within a railroad crossing and (ii) a hard wire from the one or more weight sensors to a location distal from the railroad crossing;

B. Distinguishing the transitory presence of motor vehicles crossing the railroad tracks and the prolonged presence of a motor vehicle at rest within the railroad crossing;

C. In the event of a motor vehicle at rest within the railroad crossing, transmitting a signal from the location of the railroad crossing along the hard wire to a mechanical trip switch in the location of an approaching train;

D. When the approaching train trips the mechanical switch, the approaching train is notified that a stop is required;

E. Activating the brakes of the train; and

F. Stopping the train prior to collision with the motor vehicle at rest on the railroad tracks.

* * * * *